US011391497B2

(12) United States Patent
Saho et al.

(10) Patent No.: US 11,391,497 B2
(45) Date of Patent: Jul. 19, 2022

(54) REFRIGERATION APPARATUS AND TEMPERATURE CONTROL APPARATUS

(71) Applicant: SHINWA CONTROLS CO., LTD, Kawasaki (JP)

(72) Inventors: Takuya Saho, Kawasaki (JP); Satoru Kuwahata, Kawasaki (JP); Hitoya Mitsuduka, Kawasaki (JP)

(73) Assignee: Shinwa Controls Co., Ltd, Kawasaki (JP)

( * ) Notice: Subject to any disclaimer, the term of this patent is extended or adjusted under 35 U.S.C. 154(b) by 65 days.

(21) Appl. No.: 16/500,217

(22) PCT Filed: May 11, 2018

(86) PCT No.: PCT/JP2018/018369
§ 371 (c)(1),
(2) Date: Oct. 2, 2019

(87) PCT Pub. No.: WO2018/212101
PCT Pub. Date: Nov. 22, 2018

(65) Prior Publication Data

US 2021/0108840 A1 Apr. 15, 2021

(30) Foreign Application Priority Data

May 18, 2017 (JP) ..... JP2017-099238

(51) Int. Cl.
*F25B 41/20* (2021.01)
*F25B 13/00* (2006.01)
(Continued)

(52) U.S. Cl.
CPC ..... *F25B 41/20* (2021.01); *F25B 13/00* (2013.01); *F25B 39/02* (2013.01); *F25B 40/02* (2013.01)

(58) Field of Classification Search
CPC ..... F25B 41/20; F25B 39/02; F25B 13/00; F25B 2400/05; F25B 2400/13;
(Continued)

(56) References Cited

U.S. PATENT DOCUMENTS

2013/0180276 A1* 7/2013 Choi ..... F25B 7/00 62/190
2015/0020535 A1* 1/2015 Hatomura ..... F25B 13/00 62/160
2015/0285539 A1* 10/2015 Kopko ..... F25B 49/02 62/115

FOREIGN PATENT DOCUMENTS

JP 09145169 A * 6/1997
JP H09-145169 A1 6/1997
(Continued)

OTHER PUBLICATIONS

English Translation of JP-2014070822-A (Year: 2021).*
(Continued)

*Primary Examiner* — Larry L Furdge
(74) *Attorney, Agent, or Firm* — Burr & Brown, PLLC

(57) ABSTRACT

A refrigeration apparatus includes first and second refrigeration circuits, and a supercooling circuit. The supercooling circuit includes a supercooling bypass flow path which communicates a part of the first refrigeration circuit positioned on the downstream side of the condenser and on the upstream side of the first expansion valve, to a compressor on the first refrigeration circuit; a supercooling control valve; and a supercooling heat exchanger disposed on the downstream side of the supercooling control valve in the supercooling bypass flow path. The supercooling heat exchanger is configured to cool the refrigerant flowing through a part of the first refrigeration circuit, on the downstream side of a connection position to the supercooling bypass flow path. The second refrigeration circuit
(Continued)

includes: a branch flow path which branches from a part of the first refrigeration circuit, on the upstream side of the connection position to the supercooling bypass flow path.

6 Claims, 4 Drawing Sheets

(51) Int. Cl.
*F25B 39/02* (2006.01)
*F25B 40/02* (2006.01)

(58) Field of Classification Search
CPC ..... F25B 2400/054; F25B 2400/0401; F25B 2400/0409; F25B 2600/0271; F25B 2600/0272; F25B 2313/0233; F25B 40/00; F25B 7/00
See application file for complete search history.

(56) References Cited

FOREIGN PATENT DOCUMENTS

| | | | | | |
|---|---|---|---|---|---|
| JP | 2006-03 8323 | A1 | | 2/2006 | |
| JP | 2006038323 | A | * | 2/2006 | |
| JP | 2013-002801 | A1 | | 1/2013 | |
| JP | 2013002801 | A | * | 1/2013 | |
| JP | 2013-142537 | A1 | | 7/2013 | |
| JP | 2013142537 | A | * | 7/2013 | ..... F25B 7/00 |
| JP | 2014-070822 | A1 | | 4/2014 | |
| JP | 2014070822 | A | * | 4/2014 | ..... F25B 13/00 |
| JP | 5682606 | B2 | | 3/2015 | |

OTHER PUBLICATIONS

English Translation of JP-2006038323-A (Year: 2021).*
English Translation of JP-20-2013142537-A (Year: 2021).*
English Translation of JP-09145169-A (Year: 2021).*
English Translation of JP-2013002801-A (Year: 2021).*
English translation of International Preliminary Report on Patentability (Chapter I) (Application No. PCT/JP2018/018369) dated Nov. 28, 11 pages.
Chinese Office Action (Application No. 201880031366.1) dated Nov. 27, 2020.
International Search Report and Written Opinion (Application No. PCT/JP2018/018369) dated Jul. 24, 2018.

* cited by examiner

REFRIGERATION APPARATUS AND TEMPERATURE CONTROL APPARATUS

FIELD OF THE INVENTION

The present invention relates to a refrigeration apparatus capable of efficiently cooling a plurality of objects or spaces whose temperatures are to be controlled, and a temperature control apparatus comprising the same.

BACKGROUND ART

A temperature control apparatus is known, which comprises: a refrigeration apparatus including a compressor, a condenser, an expansion valve and an evaporator; and a liquid circulation apparatus which circulates a liquid such as brine; in which the liquid of the liquid circulation apparatus is cooled by the evaporator of the refrigeration apparatus (for example, JP2006-38323A). Such a temperature control apparatus is generally provided with a heater for heating a liquid. This makes it possible to cool and heat a liquid, and a temperature of the liquid can be precisely controlled to a desired one.

SUMMARY OF THE INVENTION

In the aforementioned temperature control apparatus, it is sometimes desired that a temperature-controlled liquid is supplied to a plurality of objects to be temperature-controlled (temperature control objects). At this time, a plurality of liquid circulation apparatuses may be provided correspondingly to a plurality of refrigeration apparatuses. However, such a structure increases the unit size and also energy consumption.

In particular, in a case where a temperature control range required by one or some of the temperature control objects differs from that of another/others, when the same refrigeration apparatus and the same liquid circulation apparatus are combined to constitute a temperature control apparatus, energy consumption and manufacturing cost may be undesirably increased because of excessively high performance or spec. On the other hand, even if the combination of the refrigeration apparatus and the liquid circulation apparatus is different from that of another/other in accordance with required temperature control ranges, the large unit size problem cannot be sufficiently solved. In addition, the number of components to be used increases, which may increase the burden of assembly work.

The present invention has been made in view of such circumstances. The object of the present invention is to provide: a refrigeration apparatus capable of efficiently cooling a plurality of objects or spaces whose temperatures are to be controlled (temperature control objects or spaces), while reducing the unit size; and a temperature control apparatus comprising such a refrigeration apparatus.

A refrigeration apparatus of the present invention comprises:

a first refrigeration circuit in which a compressor, a condenser, a first expansion valve and a first evaporator are connected such that a refrigerant is circulated in this order;

a supercooling circuit including: a supercooling bypass flow path which communicates a part of the first refrigeration circuit, the part being positioned on the downstream side of the condenser and on the upstream side of the first expansion valve, to a part of the first refrigeration circuit, the part being positioned on the compressor or on the upstream side of the compressor and on the downstream side of the first evaporator, such that the refrigerant can flow therethrough; a supercooling control valve which controls a flowrate of the refrigerant flowing through the supercooling bypass flow path; and a supercooling heat exchanger disposed on the downstream side of the supercooling control valve in the supercooling bypass flow path, the supercooling heat exchanger being configured to heat-exchange the refrigerant which has flown to the downstream side of the supercooling control valve, with the refrigerant which flows through a part of the first refrigeration circuit, the part being positioned on the downstream side of the condenser and on the upstream side of the first expansion valve, and the part being on the downstream side of a connection position to the supercooling bypass flow path; and a second refrigeration circuit including: a branch flow path which communicates a part of the first refrigeration circuit, the part being on the downstream side of the condenser and on the upstream side of the first expansion valve, and the part being on the upstream side of the connection position to the supercooling bypass flow path, to a part of the first refrigeration circuit, the part being on the downstream side of the first evaporator and on the upstream side of the compressor, such that the refrigerant can flow therethrough; a second expansion valve disposed on the branch flow path, the second expansion valve being configured to expand the refrigerant received therein and to allow the refrigerant to flow out therefrom; and a second evaporator disposed on the downstream side of the second expansion valve in the branch flow path, the second evaporator being configured to evaporate the refrigerant having flown out from the second expansion valve.

In the refrigeration apparatus of the present invention, the first expansion valve and the first evaporator, and the second expansion valve and the second evaporator are connected to the common compressor and the condenser on their respective upstream sides. The refrigerant which has been ejected from the compressor to flow out from the condenser can be allowed to flow through the first evaporator via the first expansion valve, and also can be allowed to flow through the second evaporator via the second expansion valve. Thus, the respective evaporators can cool different temperature control objects or spaces. Thus, a plurality of temperature control objects or spaces can be efficiently cooled, while reducing the unit size. In particular, when a temperature control range required by one of the plurality of temperature control objects or spaces differs from that of another/others, a temperature control object or space which requires a wider temperature control range may be cooled by the first evaporator through which the refrigerant having been supercooled by the supercooling heat exchanger flows, and the other temperature control object or space may be cooled by the second evaporator, whereby energy consumption can be particularly effectively suppressed while reducing the unit size of the refrigeration apparatus.

The refrigeration apparatus of the present invention may further comprise an injection circuit including: an injection flow path which communicates a part of the first refrigeration circuit, the part being on the downstream side of the condenser and on the upstream side of the first expansion valve, and the part being on the downstream side of a position at which the refrigerant is heat-exchanged by the supercooling heat exchanger, to a part of the branch flow path, the part being on the downstream side of the second evaporator or a part of the first refrigeration circuit, the part being on the downstream side of the first evaporator and on the upstream side of the compressor, such that the refrigerant can flow therethrough; and an injection valve which can adjust a flowrate of the refrigerant flowing through the injection flow path.

In this structure, since the condensed refrigerant bypassed through the injection circuit can be mixed with the refrigerant having flown out to the downstream side of the first evaporator, a temperature or a pressure of the refrigerant flowing into the compressor can be easily adjusted to a desired state. Thus, the operation of the compressor can be made stable so that the temperature control stability can be improved.

In addition, the refrigeration apparatus of the present invention may further comprise a return circuit including: a return flow path which communicates a part of the first refrigeration circuit, the part being on the downstream side of the compressor and on the upstream side of the condenser, to a part of the first refrigeration circuit, the part being on the downstream side of the first evaporator and on the upstream side of the compressor, such that the refrigerant can flow therethrough; and a return adjustment valve which can adjust a flowrate of the refrigerant flowing through the return flow path.

In this structure, when the refrigerant on the upstream side of the compressor has an undesirably low temperature or low pressure, the refrigerant having a high temperature and a high pressure, which has been ejected from the compressor, is returned to the upstream side of the compressor through the return circuit. Thus, the refrigerant on the upstream side of the compressor can be adjusted to a desired state, and then the refrigerant in the desired state can be allowed to flow into the compressor.

The return adjustment valve may be configured such that its opening degree is adjusted depending on a pressure difference between a pressure of the refrigerant which flows through a part of the first refrigeration circuit, the part being on the downstream side of the compressor and on the upstream side of the condenser, and a pressure of the refrigerant which flows through a part of the first refrigeration circuit, the part being on the downstream side of the first evaporator and on the upstream side of the compressor, and the part being on the downstream side of a connection position to the branch flow path.

In this structure, when the refrigerant on the upstream side of the compressor has an undesirably low temperature or low pressure, the refrigerant on the upstream side of the compressor can be adjusted to a desired state, and the refrigerant in the desired state can be allowed to flow into the compressor, without complicating the structure.

In addition, the refrigeration apparatus of the present invention may further comprise a heating-medium flow apparatus including: a first cooling flow path connected to the condenser, the first cooling flow path being configured to supply the condenser with a heating medium for condensing the refrigerant flowing through the condenser and to allow the heating medium having flown out from the condenser to flow therethrough; a second cooling flow path which communicates a part of the first cooling flow path, the part being positioned on the upstream side of the condenser, to a part of the first cooling flow path, the part being positioned on the downstream side of the condenser, such that the heating medium can flow therethrough; and a cooling heat exchanger disposed on the second cooling flow path.

In this structure, by allowing the heating medium for condensing the refrigerant, which flows through the first refrigeration circuit, to flow through the cooling heat exchanger, temperature control by the cooling heat exchanger can be enabled, whereby the number of temperature control objects or spaces whose temperatures can be controlled can be further increased, without increasing the unit size.

In addition, a temperature control apparatus of the present invention comprises: the aforementioned refrigeration apparatus; a first liquid flow apparatus including a first liquid flow path connected to the first evaporator in the first refrigeration circuit, the first liquid flow path being configured to supply the first evaporator with a first liquid to be cooled by the refrigerant flowing through the first evaporator and to allow the first liquid having flown out from the first evaporator to flow therethrough; and a second liquid flow apparatus including a second liquid flow path connected to the second evaporator in the second refrigeration circuit, the second liquid flow path being configured to supply the second evaporator with a second liquid to be cooled by the refrigerant flowing through the second evaporator and to allow the second liquid having flown out from the second evaporator to flow therethrough.

In this structure, the first liquid and the second liquid different from each other can be efficiently cooled, while reducing the unit size.

In the temperature control apparatus of the present invention, the first liquid flow apparatus may include a first heater which heats the first liquid having been cooled by the refrigerant, and the second liquid flow apparatus may include a second heater which heats the second liquid having cooled by the refrigerant.

In this structure, by heating the cooled first liquid or the second liquid, the respective liquids can be precisely controlled to desired temperature.

According to the present invention, a plurality of temperature control objects or spaces can be efficiently cooled, while reducing the unit size.

DETAILED DESCRIPTION OF THE INVENTION

One embodiment of the present invention is described herebelow.

<Schematic Structure of Temperature Control Apparatus>

Figure 1:
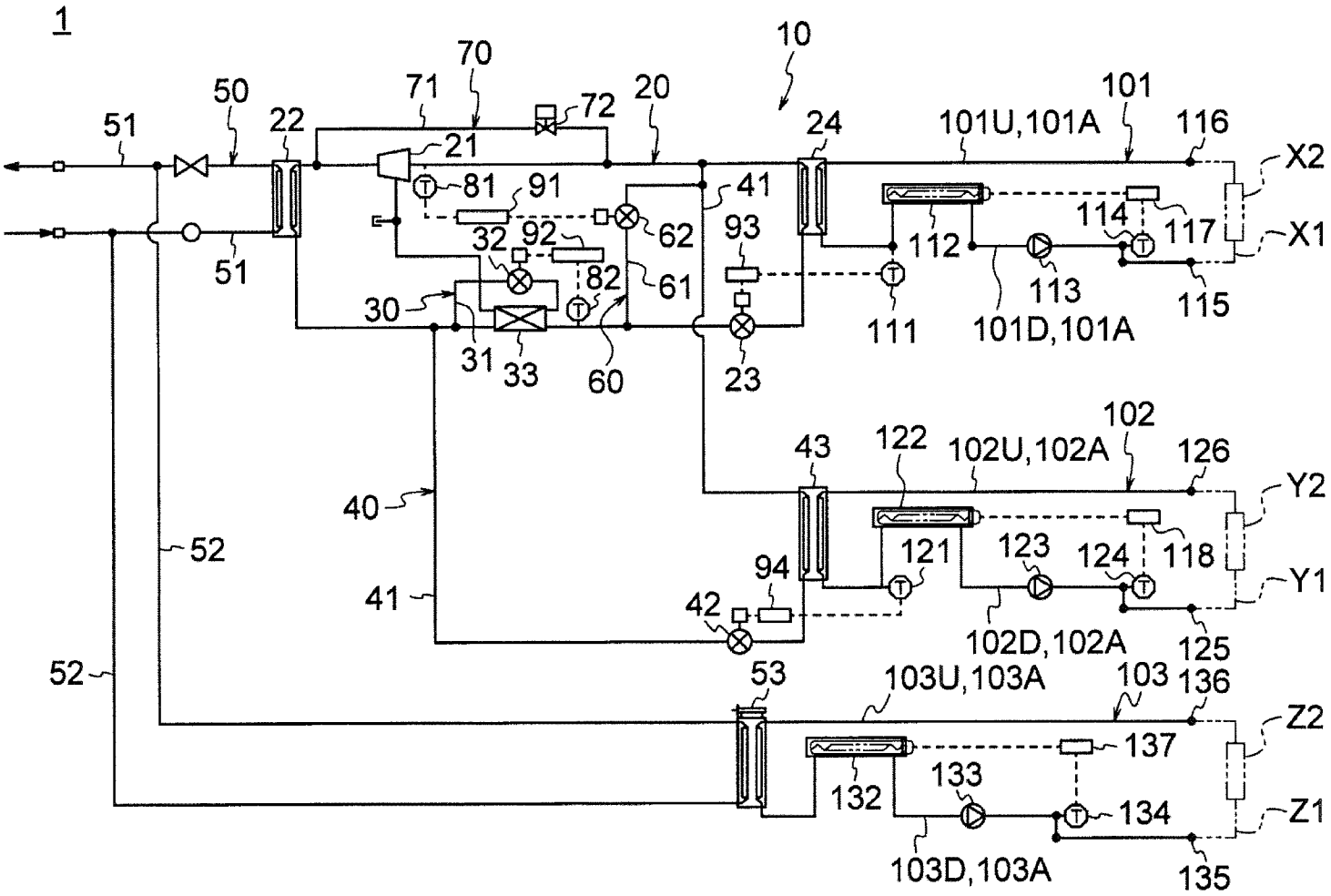
FIG. 1 is a view showing a schematic structure of a temperature control apparatus according to one embodiment of the present invention.

FIG. 1 is a view showing a schematic structure of a temperature control apparatus 1 according to one embodiment of the present invention. As shown in FIG. 1, the temperature control apparatus 1 according to this embodiment comprises a refrigeration apparatus 10, a first liquid flow apparatus 101, a second liquid flow apparatus 102, and a third liquid flow apparatus 103. In the temperature control apparatus 1, a first liquid which flows through the first liquid flow apparatus 101, a second liquid which flows the second liquid flow apparatus 102, and a third liquid which flows through the third liquid flow apparatus 103 are separately cooled by the refrigeration apparatus 10, whereby a plurality of objects whose temperatures are to be controlled (temperature control objects) or spaces whose temperatures are to be controlled different from one another can be cooled by the respective liquids. In this embodiment, brines are supposed to be used as the first to third liquids, but another liquid may be used.

(Refrigeration Apparatus)

The refrigeration apparatus 10 is firstly described in detail. The refrigeration apparatus 10 comprises a first refrigeration circuit 20, a supercooling circuit 30, a second refrigeration circuit 40, a heating-medium flow apparatus 50, an injection circuit 60, and a return circuit 70.

The first refrigeration circuit 20 is constituted by connecting a compressor 21, a condenser 22, a first expansion valve 23 and a first evaporator 24 by means of pipes, such that a refrigerant flows therethrough in this order. In the first refrigeration circuit 20, a refrigerant compressed by the compressor 21 flows into the condenser 22, and the refrigerant having flown into the condenser 22 is condensed by a heating medium which is allowed to flow by the aforementioned heating-medium flow apparatus 50 in this embodiment. Thereafter, the refrigerant is decompressed by the first expansion valve 23 so as to have a low temperature, and the refrigerant flows into the first evaporator 24. The refrigerant having flown into the first evaporator 24 flows into the compressor 21 after heat exchange. Thereafter, the refrigerant is compressed again by the compressor 21. The first refrigeration circuit 20 in this embodiment is configured to heat-exchange the refrigerant which flows through the first evaporator 24, with the first liquid which flows through the first liquid flow apparatus 101 so as to cool the first liquid.

The supercooling circuit 30 includes a supercooling bypass flow path 31, a supercooling control valve 32, and a supercooling heat exchanger 33. The supercooling bypass flow path 31 communicates (connects) a part of the first refrigeration circuit 20, the part being positioned on the downstream side of the condenser 22 and on the upstream side of the first expansion valve 23, to the compressor 21 in the first refrigeration circuit 20, such that the refrigerant can flow therethrough. In this embodiment, one end of a pair of ends of the supercooling bypass flow path 31 is connected to a pipe part which is positioned on the downstream side of the condenser and on the upstream side of the first expansion valve 23, and the other end is connected to the compressor 21. However, the other end may be connected to a part which is positioned on the upstream side of the compressor 21 and on the downstream side of the first evaporator 24.

The supercooling control valve 32 is configured to control a flowrate of the refrigerant flowing through the supercooling bypass flow path 31. The supercooling heat exchanger 33 is disposed on the downstream side of the supercooling control valve 32 in the supercooling bypass flow path 31, and is configured to heat-exchange the refrigerant which has flown to the downstream side of the supercooling control valve 32, with the refrigerant which flows through a part of the first refrigeration circuit 20, the part being positioned on the downstream side of the condenser 22 and on the upstream side of the first expansion valve 23, and the part being on the downstream side of a connection position to the supercooling bypass flow path 31. In the supercooling heat exchanger 33, by opening the supercooling control valve 32, the condensed refrigerant flowing on the downstream side of the condenser 22 is expanded on the downstream side of the supercooling control valve 32 in the supercooling bypass flow path 31 so as to have a low temperature. Thus, a degree of supercooling can be given to the refrigerant which flows from the condenser 22 toward the first expansion valve 23 through the supercooling heat exchanger 33. On the other hand, the refrigerant having flown through the supercooling bypass flow path 31 flows into the compressor 21. At this time, the refrigerant coming from the supercooling bypass flow path 31 flows into the compressor 31, in the course of the compressing step by the compressor 21 which compresses the refrigerant coming from the first evaporator 24, so as to be compressed together with the refrigerant coming from the first evaporator 24.

The second refrigeration circuit 40 includes a branch flow path 41, a second expansion valve 42, and a second evaporator 43. The branch flow path 41 communicates (connects) a part of the first refrigeration circuit 20, the part being on the downstream side of the condenser 22 and on the upstream side of the first expansion valve 23, and the part being on the upstream side of the connection position to the supercooling bypass flow path 31, to a part of the first refrigeration circuit 20, the part being on the downstream side of the first evaporator 24 and on the upstream side of the compressor 21, such that the refrigerant can flow therethrough. The second expansion valve 42 is disposed on the branch flow path 41, and is configured to expand the refrigerant received therein and to allow the refrigerant to flow out therefrom. The second evaporator 43 is disposed on the downstream side of the second expansion valve 42 in the branch flow path 41, and is configured to evaporate the refrigerant having flown out from the second expansion valve 42. The second refrigeration circuit 40 is configured to heat-exchange the refrigerant which flows through the second evaporator 43, with the second liquid which flows through the second liquid flow apparatus 102 so as to cool the second liquid The heating-medium flow apparatus 50 includes: a first cooling flow path 51, which is connected to the condenser 22 and which supplies the condenser 22 with a heating medium for condensing the refrigerant flowing through the condenser 22 and allows the heating medium having flown out from the condenser 22 to flow therethrough; a second cooing flow path 52, which communicates (connects) a part of the first cooling flow path 51, the part being positioned on the upstream side of the condenser 22, to a part of the first cooling flow path 51, the part being positioned on the downstream side of the condenser 22, such that the heating medium can flow therethrough; and a cooling heat exchanger 53 disposed on the second cooling flow path 52.

The first cooling flow path 51 is connected to the condenser 22 to pass through the condenser 22, and is configured to allow the heating medium ejected by a pump, not shown, to flow therethrough. The heating medium is cooling water for cooling the refrigerant passing through the condenser. Although water is used as the heating medium in this embodiment, another cooing water may be used. In addition, the first cooling flow path 51 is provided with valves respectively disposed on the upstream side and the down stream side of the condenser 22, in order to adjust a flowrate of the heating medium flowing through the condenser 22. This embodiment employs a structure in which water ejected by the pump flows therethrough the first cooling flow path 51 to pass through the condenser 22, and then the water is ejected. However, the first cooling flow path 51 may be a part of a refrigerator which performs a refrigeration cycle.

The second cooling flow path 52 of the heating-medium flow apparatus 50 is provided for returning the heating medium which branched from the first cooling flow path 51, to the first cooing flow path 51 through the cooing heat exchanger 53. In addition, the cooing heat exchanger 53 is capable of cooling a temperature control object or a space by means of the heating medium. In this embodiment, the cooing heat exchanger 53 is configured to heat-exchange the heating medium flowing therethrough with the third liquid flowing through the third liquid flow apparatus 103 so as to cool the third liquid.

The injection circuit 60 includes: an injection flow path which communicates (connects) a part of the first refrigeration circuit 20, the part being on the down stream side of the condenser 22 and on the upstream side of the first expansion valve 23, and the part being on the downstream side of a position at which the refrigerant is heat-exchanged by the supercooling heat exchanger 33, to a part of the branch flow path 41, the part being on the downstream side of the second evaporator 43, such that the refrigerant can flow therethrough; and an injection valve 62 which can adjust a flowrate of the refrigerant flowing through the injection flow path 61.

In the injection circuit 60, by adjusting an opening degree of the injection valve 62, the refrigerant which has been cooled by the supercooling heat exchanger 33 on the downstream side of the condenser, can be bypassed to the upstream side of the condenser 21. Thus, a temperature or a pressure of the refrigerant having flown out from the first evaporator 24 can be lowered. In this embodiment, one end of a pair of ends of the injection circuit 60 is connected to a pipe part, the part being on the downstream side of the condenser 22 and on the upstream side of the first expansion valve 23 and on the downstream side of a position at which the refrigerant is heat-exchanged by the supercooling heat exchanger 33, and the other end is connected to the branch flow path 41. However, the other end may be connected to a part of the first refrigeration circuit 20, the part being on the downstream side of the first evaporator 24 and on the upstream side of the compressor 21.

In addition, the return circuit 70 includes: a return flow path 71 which communicates (connects) a part of the first refrigeration circuit 20, the part being on the downstream side of the compressor 21 and on the upstream side of the condenser 22, to a part of the first refrigeration circuit 20, the part being on the downstream side of the first evaporator 24 and on the upstream side of the compressor 21, such that the refrigerant can flow therethrough; and a return adjustment valve 72 which can adjust a flowrate of the refrigerant flowing through the return flow path 71.

In this embodiment, the return adjustment valve 72 is configured such that its opening degree is adjusted depending on a pressure difference between a pressure of the refrigerant which flows through a part of the first refrigeration circuit 20, the part being on the downstream side of the compressor 21 and on the upstream side of the condenser 22, and a pressure of the refrigerant which flows through a part of the first refrigeration circuit 20, the part being on the downstream side of the first evaporator 24 and on the upstream side of the compressor 21, and the part being on the downstream side of a connection position to the branch flow path 41. In more detail, the larger the pressure difference between a pressure on the upstream side of the compressor 21 and a pressure on the downstream side thereof is, the more the return adjustment valve 72 increases its opening degree. Thus, a pressure on the upstream side of the compressor 21 can be automatically adjusted to a desired value.

As shown in FIG. 1, the refrigeration apparatus 10 is provided with a plurality of temperature sensors and a plurality of controllers. For example, a compressor-upstream temperature sensor 81 is disposed on the upstream side of the compressor 21 in the first refrigeration circuit 20. The compressor-upstream temperature sensor 81 detects a temperature of the refrigerant which flows through a part of the first refrigeration circuit 20, the part being on the upstream side of the compressor 21 and on the downstream side of the first evaporator 24, and the part being on the downstream side on the connection position to the branch flow path 41 and on the downstream side of a connection position to the return flow path 71. The compressor-upstream temperature sensor 81 is electrically connected to an injection controller 91, and the injection controller 91 is electrically connected to the injection valve 62. The injection controller 91 in this embodiment can control an opening degree of the injection valve 62, such that a temperature detected by the compressor-upstream temperature sensor 81 has a desired value.

In addition, a supercooling-downstream temperature sensor 82 is disposed on the downstream side of the supercooling heat exchanger 33 in the first refrigeration circuit 20. The supercooling-downstream temperature sensor 82 detects a temperature of the refrigerant which flows through a part of the first refrigeration circuit 20, the part being on the downstream side of the position at which the refrigerant is heat-exchanged by the supercooling heat exchanger 33, and on the upstream side of the first expansion valve 23. The supercooling-downstream temperature sensor 82 is electrically connected to a supercooling controller 92, and the supercooling controller 92 is electrically connected to the supercooling control valve 32. The supercooling controller 92 in this embodiment can control an opening degree of the supercooling control valve 32, such that a temperature detected by the supercooling-downstream temperature sensor 82 has a desired value.

In addition, a first expansion-valve controller 93 is electrically connected to the first expansion valve 23, and the first expansion-valve controller 93 is electrically connected to a cooling-side first temperature sensor 111 provided on the first liquid flow apparatus 101, so that an opening degree of the first expansion valve 23 can be controlled depending on a temperature of the first liquid. In addition, a second expansion-valve controller 94 is electrically connected to the second expansion valve 42, and the second expansion-valve controller 94 is electrically connected to a cooling-side second temperature sensor 121 provided on the second liquid flow apparatus 102, so that an opening degree of the second expansion valve 42 can be controlled depending on a temperature of the second liquid.

(Liquid Flow Apparatus)

Next, the first to third liquid flow apparatuses 101 to 103 are described.

Firstly, the first liquid flow apparatus 101 includes a first liquid flow path 101A connected to the first evaporator 24 in the first refrigeration circuit 20, the first liquid flow path 10A being configured to supply the first evaporator 24 with the first liquid to be cooled by the refrigerant flowing through the first evaporator 24 and to allow the first liquid having flown out from the first evaporator 24 to flow therethrough. The first liquid flow path 101A includes a downstream part 101D which receives the first liquid having flown out from the first evaporator 24 and allows the first liquid to flow therethrough, and an upstream part 1010 which supplies the first liquid into the first evaporator 24. The aforementioned cooling-side first temperature sensor 111, a first heater 112, a first pump 113 and a heating-side first temperature sensor 114 are disposed on the downstream part 101D.

An ejection part 115 for ejecting the first liquid is disposed on an end of the downstream part 101D, which is opposed to the side of the first evaporator 24. A pipe through which the first liquid flows can be connected to the ejection part 115. On the other hand, a reception part 116 capable of receiving the first liquid is disposed on an end of the upstream part 1010, which is opposed to the side of the first evaporator 24. A pipe through which the first liquid flows can be connected to the reception part 116.

In addition, the cooling-side first temperature sensor 111 is configured to detect a temperature of the first liquid immediately after the first liquid has flown out from the first evaporator 24. As described above, the cooling-side first temperature sensor 111 is electorally connected to the first expansion-valve controller 93. The first heater 112 is disposed on the downstream side of the cooling-side first temperature sensor 111 in the downstream part 101D, and is configured to heat the first liquid flowing thereinto from the first evaporator 24 and to allow the first liquid to flow out therefrom. The first pump 113 is disposed on the downstream side of the first heater 112 in the downstream part 101D, and is driven to allow the first liquid in the downstream part 101D to flow from the first evaporator 24 toward the ejection part 115. In addition, the heating-side first temperature sensor 114 is disposed on the downstream side of the first pump 113 in the downstream part 101D. Herein, the heating-side first temperature sensor 114 and the first heater 112 are electrically connected to a first heating-amount controller 117. The first heating-amount controller 117 in this embodiment can control a heating amount of the first heater 112, such that a temperature detected by the heating-side first temperature sensor 114 has a desired value.

In the above-mentioned first liquid flow apparatus 101 in this embodiment, as shown in FIG. 1, for example, a pipe X1 shown by the two-dot chain lines is provided between the ejection part 115 and the reception part 116, and heat of a temperature control object X2 is absorbed by the first liquid in the pipe X1, or the first liquid in the pipe X1 dissipates heat to the temperature control object X2, so that a temperature of the temperature control object X2 can be controlled. To be specific, in this embodiment, the first liquid absorbs the heat of the temperature control object X2, whereby the temperature control object X2 can be cooled.

Next, the second liquid flow apparatus 102 includes a second liquid flow path 102A connected to the second evaporator 43 in the second refrigeration circuit 40, the second liquid flow path 102A being configured to supply the second evaporator 43 with the second liquid to be cooled by the refrigerant flowing through the second evaporator 43 and to allow the second liquid having flown out from the second evaporator 43 to flow therethrough. The second liquid flow path 102A includes a downstream part 102D which receives the second liquid having flown out from the second evaporator 43 and allows the second liquid to flow therethrough, and an upstream part 102U which supplies the second liquid into the second evaporator 43. The aforementioned cooling-side second temperature sensor 121, a second heater 122, a second pump 123 and a heating-side second temperature sensor 124 are disposed on the downstream part 102D.

An ejection part 125 for ejecting the second liquid is disposed on an end of the downstream part 102D, which is opposed to the side of the second evaporator 43. A pipe through which the second liquid flows can be connected to the ejection part 125. On the other hand, a reception part 126 capable of receiving the second liquid is disposed on an end of the upstream part 102U. A pipe through which the second liquid flows can be connected to the reception part 126.

In addition, the cooling-side second temperature sensor 121 is configured to detect a temperature of the first liquid immediately after the second liquid has flown out from the second evaporator 43. As described above, the cooling-side second temperature sensor 121 is electrically connected to the second evaporation-valve controller 94. The second heater 122 is disposed on the downstream side of the cooling-side second temperature sensor 121 in the downstream part 102D, and is configured to heat the second liquid flowing thereinto from the second evaporator 43 and to allow the second liquid to flow out therefrom. The second pump 123 is disposed on the downstream side of the second heater 122 in the downstream part 102D, and is driven to allow the second liquid in the downstream part 102D to flow from the second evaporator 43 toward the ejection part 125. In addition, the heating-side second temperature sensor 124 is disposed on the downstream side of the second pump 123 in the downstream part 102D. Herein, the heating-side second temperature sensor 124 and the second heater 122 are electrically connected to a second heating-amount controller 127. The second heating-amount controller 127 in this embodiment can control a heating amount of the second heater 122, such that a temperature detected by the heating-side second temperature sensor 124 has a desired value.

In the above-mentioned second liquid flow apparatus 102 in this embodiment, as show in FIG. 1, for example, a pipe Y1 shown by the two-dot chain lines is provided between the ejection part 125 and the reception part 126, and heat of a temperature control object Y2 is absorbed by the second liquid in the pipe Y1, or the second liquid in the pipe Y1 dissipates heat to the temperature control object Y2, so that a temperature of the temperature control object Y2 can be controlled. To be specific in this embodiment, the second liquid absorbs the heat of the temperature control object Y2, whereby the temperature control object Y2 can be cooled.

The third liquid flow apparatus 103 includes a third liquid flow path 103A connected to the cooing heat exchanger 53 in the heating-medium flow apparatus 50, the third liquid flow apparatus 103 being configured to supply the cooling heat exchanger 53 with the third liquid to be cooled by the heating medium flowing through the cooling heat exchanger 53 and to allow the third liquid having flown out from the cooling heat exchanger 53 to flow therethrough. The third liquid flow path 103A includes a downstream part 103D which receives the third liquid having flown out from the cooling heat exchanger 53 and allows the third liquid to flow therethrough, and an upstream part 103U which supplies the first liquid into the cooling heat exchanger 53. A third heart 132, a third pump 133 and a heating-side third temperature sensor 134 are disposed on the downstream part 103D.

An ejection part 135 for ejecting the third liquid is disposed on an end of the downstream part 103D, which is opposed to the side of the cooling heat exchanger 53. A pipe through which the third liquid flows can be connected to the ejection part 135. On the other hand, a reception part 136 capable of receiving the third liquid is disposed on an end of the upstream part 103U, which is opposed to the side of the cooling heat exchanger 53. A pipe through which the third liquid flows can be connected to the reception part 136.

In addition, the third heater 132 is configured to heat the third liquid flowing thereinto from the cooling heat exchanger 53 and to allow the third liquid to flow out therefrom. The third pump 133 is disposed on the downstream side of the third heater 132 in the downstream part 103D, and is driven to allow the third liquid in the downstream part 103D to flow from the cooling heat exchanger 53 toward the ejection part 135. In addition, the heating-side third temperature sensor 134 is disposed on the downstream side of the third pump 133 in the downstream part 103D. Herein, the heating-side third temperature sensor 134 and the third heater 132 are electrically connected to a third heating-amount controller 137. The third heating-amount controller 137 in this embodiment can control a heating amount of the third heater 132, such that a temperature detected by the heating-side third temperature sensor 134 has a desired value.

In the above-mentioned third liquid flow apparatus 103 in this embodiment, as shown in FIG. 1, for example, a pipe Z1 shown by the two-dot chain lines is provided between the ejection part 135 and the reception part 136, and heat of a temperature control object Z2 is absorbed by the third liquid in the pipe Z1, or the third liquid in the pipe Z1 dissipates heat to the temperature control object Z2, so that a temperature of the temperature control object Z2 can be controlled. To be specific, in this embodiment, the third liquid absorbs the heat of the temperature control object Z2, whereby the temperature control object Z2 can be cooled.

(Operation of Temperature Control Apparatus)

Next, an operation example of the temperature control apparatus 1 is described. In this example, in order to enable cooling of the temperature control object X2 by the first liquid, cooling of the temperature control object Y2 by the second liquid and cooling of the temperature control object Z2 by the third liquid, the pipes X1, Y1, Z1 are respectively connected to the first to third liquid flow apparatuses 101 to 103 firstly. Thereafter, the compressor 21, the heating-medium flow apparatus 50, and the first, second and third pumps 113, 123, 133 are driven.

When the compressor 21 is driven, in the first refrigeration circuit 20 of the refrigeration apparatus 10, a refrigerant compressed by the compressor 21 flows into the condenser 22, and is condensed by a heating medium of the heating-medium flow apparatus 5. Thereafter, the refrigerant passes through the supercooling heat exchanger 33. At this time, in this embodiment, the supercooling control valve 32 is always opened. A part of the compressed refrigerant flowing on the downstream side of the condenser 22 flows into the supercooling bypass flow path 31, so as to be expanded on the downstream side of the supercooling control valve 32 to have a low temperature. Thus, a degree of supercooling is given to the refrigerant flowing from the condenser 22 toward the first expansion valve 23 through the supercooling heat exchanger 33. The refrigerant expanded by the supercooling control valve 32 flows into the compressor 21 while absorbing heat. The refrigerant having passed through the first expansion valve 23 is decompressed to have a low temperature, and flows into the first evaporator 24.

The refrigerant having flown into the first evaporator 24 heat-exchanges with the first liquid flowing through the first liquid flow apparatus 101, so as to cool the first liquid. At this time, in the first liquid flow apparatus 101, the first liquid which has been cooled by the refrigerant having flown into the first evaporator 24 is heated by the first heater 112, so that the first liquid is adjusted to have a desired value. A temperature of the temperature control object X2 is controlled by the first liquid which has been thus adjusted to have the desired temperature. The refrigerant having been heat-exchanged with the first liquid flows toward the compressor 21 so as to be compressed again by the compressor 21.

In the second refrigeration circuit 40, the refrigerant, which has branched into the branch flow path 41 on the upstream side of the supercooling heat exchanger 33, is decompressed by the second expansion valve 42 to have a low temperature, and flows into the second evaporator 43. The refrigerant having flown into the second evaporator 43 heat-exchanges with the second liquid flowing through the second liquid flow apparatus 102 so as to cool the second liquid. At this time, in the second liquid flow apparatus 102, the second liquid which has been cooled by the refrigerant having flown into the second evaporator 43 is heated by the second heater 122, so that the second liquid is adjusted to a desired temperature. A temperature of the temperature control object Y2 is controlled by the second liquid which has been thus adjusted to have the desired temperature. The refrigerant having been heat-exchanged with the second liquid is mixed with the refrigerant from the injection flow path 61 or is not mixed therewith. Then, the refrigerant flows to the downstream side of the first evaporator 24 in the first refrigeration circuit 20, and is compressed again by the compressor 21.

In the heating-medium flow apparatus 50, the heating medium having flown into the second cooling flow path 52 flows through the cooling heat exchanger 53, and then returns to the downstream side of the condenser 22 in the first cooling flow path 51. The refrigerant having flown into the cooling heat exchanger 53 heat-exchanges with the third liquid flowing through the third liquid flow apparatus 103 so as to cool the third liquid. At this time, in the third liquid flow apparatus 103, the third liquid which has been cooled by the refrigerant having flown into the cooling heat exchanger is heated by the third heater 132, so that the third liquid is adjusted to have a desired value. A temperature of the temperature control object Z2 is controlled by the third liquid which has been thus adjusted to have the desired temperature.

In this embodiment, the refrigerant having flown out from the first evaporator 24 and the refrigerant having flown out from the second evaporator 43 are mixed with each other, and the mixed refrigerant flows toward the compressor 21. In this case, a temperature or a pressure of the mixed refrigerant is likely to vary. In order to limit (or reduce or control) such a variation, the injection circuit 60 and the return circuit 70 are provided in this embodiment. To be specific, when a temperature or a pressure of the refrigerant on the upstream side of the compressor 21 is more than a predetermined value, the injection circuit 60 supplies the refrigerant, which has passed through the supercooling heat exchanger 33 so as to have a low temperature and a low pressure, from the injection flow path 61 to the upstream side of the compressor 21. In addition, when a temperature or a pressure of the refrigerant on the upstream side of the compressor 21 is less than the predetermined value, the return circuit 70 supplies the refrigerant having a high temperature and a high pressure from the return flow path 71 to the upstream side of the compressor 21. Thus, in this embodiment, since the refrigerant in an undesired state is prevented from flowing into the compressor 21, it can be prevented that the temperature control becomes unstable.

Figure 2:
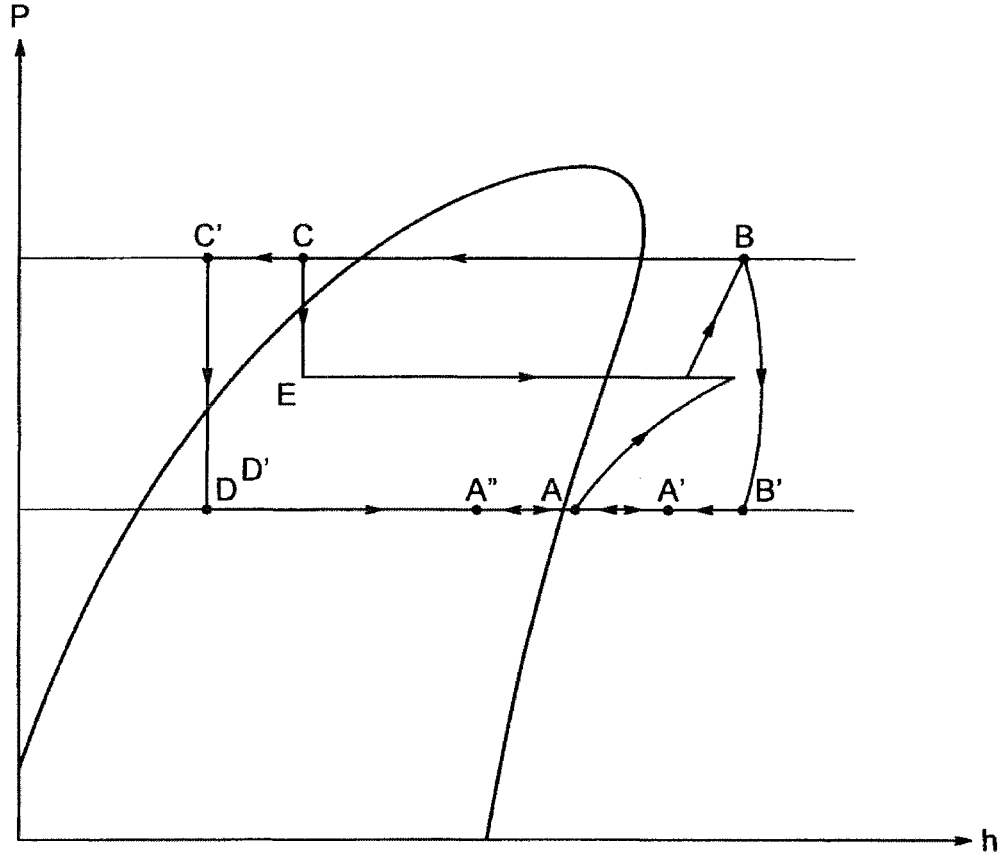
FIG. 2 is a view showing an example of a Mollier diagram of a refrigeration apparatus in the temperature control apparatus shown in FIG. 1.
Figure 3:
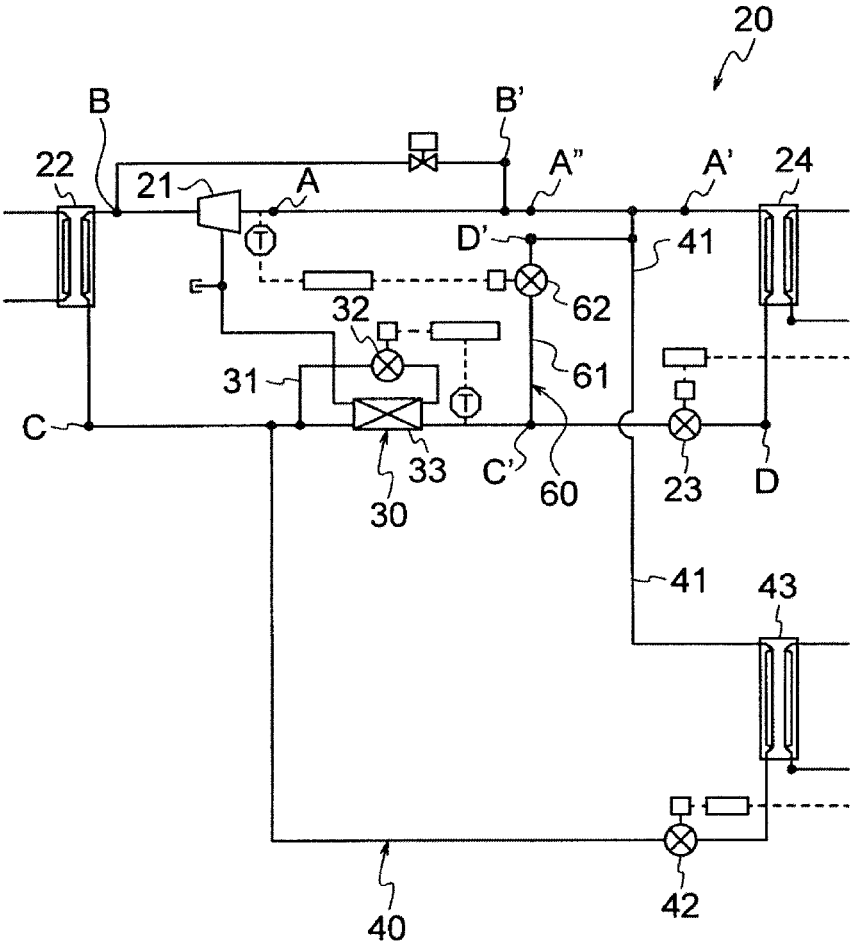
FIG. 3 is an enlarged view of the refrigeration apparatus in which a plurality of points each showing a refrigerant's state shown in the Mollier diagram of FIG. 2 are expediently shown on the refrigerant apparatus.

FIG. 2 shows a Mollier diagram of the first refrigeration circuit 20 when the injection circuit 60 and the return circuit 70 are operated. FIG. 3 is an enlarged view of the refrigeration apparatus 10, in particular, the first refrigeration circuit 20, in which a plurality of points each showing a refrigerant's state shown in the Mollier diagram of FIG. 2 are expediently shown on the refrigeration apparatus 10. In the refrigeration cycle of the first refrigeration circuit 20 shown in FIGS. 2 and 3, a refrigerant having been sucked into the compressor 21 is compressed as shown in transition from a point A to a point B. The refrigerant having been ejected by the compressor 21 is condensed by the condenser 22 so as to be cooled, so that its specific enthalpy decreases as shown by transition from the point B to a point C.

Then, a degree of supercooling is given to a part of the refrigerant, which has been condensed by the condenser 22, in the supercooling heat exchanger 33, so that its specific enthalpy decreases as shown by transition from the point C to a point C'. At this time, the refrigerant flowing through the supercooling bypass flow path 31, which gives a degree of supercooling in the supercooling heat exchanger 33, is expanded by the supercooling control valve 32 so as to be decompressed to a medium pressure, for example, as shown by the point C to a point E. Under this state, a degree of supercooling is given in the supercooling heat exchanger 33. Thereafter, the refrigerant having given the degree of supercooling with increased specific enthalpy is mixed with the refrigerant which has been compressed in the transition of the point A-the point B, so as to reach the point B.

Then, the refrigerant to which the degree of supercooling has been given in the supercooling heat exchanger 33 as described above is decompressed by the first expansion valve 23 so as to have a low temperature, as shown by transition from the point C' to a point D. After that, the refrigerant having been ejected from the first expansion valve 23 is heat-exchanged with the first liquid in the first evaporator 24. In this example, as shown by transition from the point D to a point A', the refrigerant absorbs heat so that its specific enthalpy increases.

At this time, as shown by the point A', when a degree of superheat is excessively given to the refrigerant, the injection circuit 60 mixes the refrigerant having passed through the supercooling heat exchanger 33 to have a low temperature and a low pressure, as shown in transition from the point C' to the point D', with the refrigerant to which the degree of superheat is excessively given. Thereby, as shown in transition from the point A' to a point A", the degree of superheat of the refrigerant can be decreased. At this time, in this example, as shown by the point A", the specific enthalpy of the refrigerant is excessively decreased so that a temperature or a pressure of the refrigerant is undesirably reduced. In this case, as shown by transition from the point B to a point B', the refrigerant having a high temperature and a high pressure on the downstream side of the compressor 21 is mixed by the return circuit 70 with the refrigerant having excessively reduced temperature or pressure. Thus, the refrigerant can have a desired state as shown in transition from the point A" to the point A. Since the refrigerant in the undesirable state can be prevented from flowing into the compressor 21, it can be prevented that the temperature control becomes unstable.

In the aforementioned embodiment, the first expansion valve 23 and the first evaporator 24, and the second expansion valve 42 and the second evaporator 43 are connected to the common compressor 21 and the condenser 22 on their respective upstream sides. The refrigerant which has been ejected from the compressor 21 to flow out from the condenser 22 can be allowed to flow through the first evaporator 24 via the first expansion valve 23, and also can be allowed to flow through the second evaporator 43 via the second expansion valve 42. Thus, the respective evaporators can cool different temperature control objects or spaces. Thus, a plurality of temperature control objects or spaces can be efficiently cooled, while reducing the unit size. In particular, when a temperature control range required by one of the plurality of temperature control objects or spaces differs from another/others, a temperature control object or space which requires a wider temperature control range may be cooled by the first evaporator 24 through which the refrigerant having been supercooled by the supercooling heat exchanger 33 flows, and the other temperature control object or space may be cooled by the second evaporator 43, whereby energy consumption can be particularly effectively suppressed while reducing the unit size of the refrigeration apparatus.

In addition, since the refrigeration apparatus 10 can mix the condensed refrigerant bypassed through the injection circuit 60 with the refrigerant having flown out to the downstream side of the first evaporator 24, a temperature or a pressure of the refrigerant flowing into the compressor 21 can be easily adjusted to a desired state. Thus, the operation of the compressor 21 can be made stable so that the temperature control stability can be improved. Further, when the refrigerant on the upstream side of the compressor 21 has an undesirably low temperature or low pressure, the refrigeration apparatus 10 returns the refrigerant having a high temperature and a high pressure, which has been ejected from the compressor 21, to the upstream side of the compressor 21 through the return circuit 70. Thus, the refrigerant on the upstream side of the compressor 21 can be adjusted to a desired state, and then the refrigerant in the desired state can be allowed to flow into the compressor 21. This also makes stable the operation of the compressor 21 so that the temperature control stability can be improved.

In addition, the return adjustment valve 72 in this embodiment is configured such that its opening degree is adjusted depending on a pressure difference between a pressure of the refrigerant which flows through a part of the first refrigeration circuit 20, the part being on the downstream side of the compressor 21 and on the upstream side of the condenser 22, and a pressure of the refrigerant which flows through a part of the first refrigeration circuit 20, the part being on the downstream side of the first evaporator 24 and on the upstream side of the compressor 21, and the part being on the downstream side of the connection position to the branch flow path 41. Thus, when the refrigerant on the upstream side of the compressor 21 has an undesirably low temperature or low pressure, the refrigerant on the upstream side of the compressor 21 can be adjusted to a desired state, and the refrigerant in the desired state can be allowed to flow into the compressor, without complicating the structure.

In addition, the refrigeration apparatus 10 further comprises the heating-medium flow apparatus 50 including: the first cooling flow path 51, which supplies the condenser 22 with the heating medium for condensing the refrigerant flowing through the condenser 22 and allows the heating medium having flown out from the condenser 22 to flow therethrough; the second cooling flow path 52, which communicates a part of the first cooling flow path 51, the part being positioned on the upstream side of the condenser 22, and a part of the first cooling flow path 51, the part being positioned on the downstream side of the condenser 22, such that the heating medium can flow therethrough; and the cooling heat exchanger 53 disposed on the second cooling flow path 52. Thus, by allowing the heating medium for condensing the refrigerant, which flows through the first refrigeration circuit 20, to flow through the cooling heat exchanger 53, temperature control by the cooling heat exchanger 53 can be enabled, whereby the number of temperature control objects or spaces whose temperatures can be controlled can be further increased, without increasing the unit size.

(Application Example of Temperature Control Apparatus)

Figure 4:
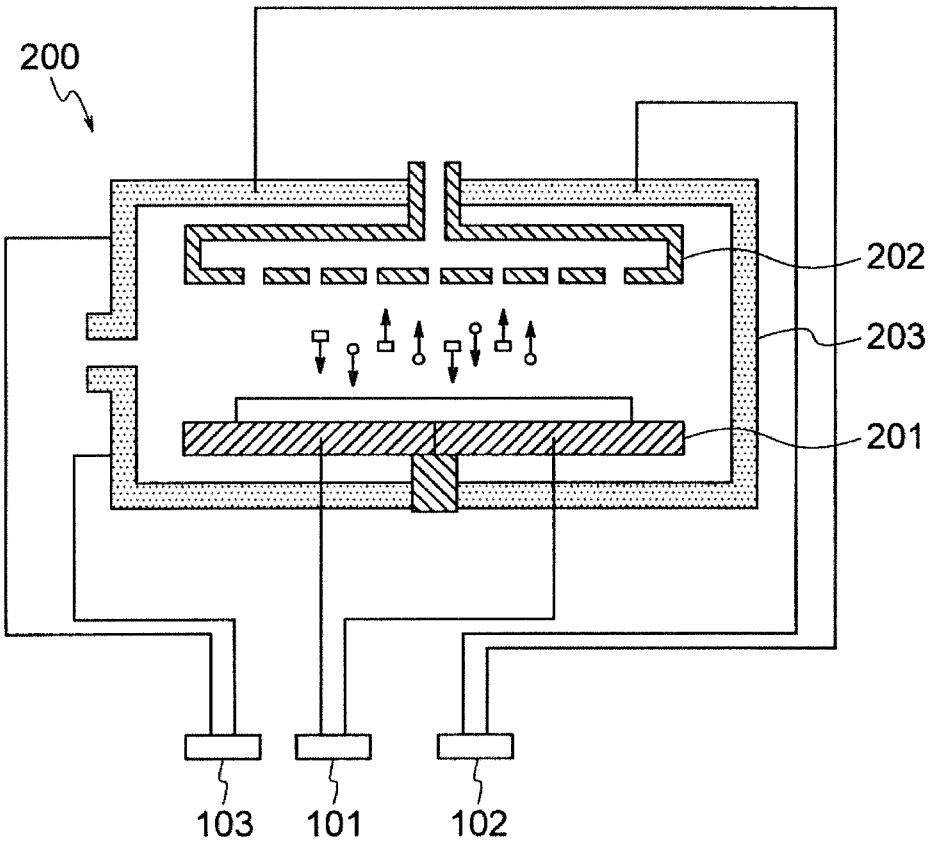
FIG. 4 is a schematic view of a semiconductor manufacturing system constituted by connecting the temperature control apparatus shown in FIG. 1 to a plasma etching apparatus.

FIG. 4 is a schematic view of a semiconductor manufacturing system constituted by connecting the temperature control apparatus 1 according to this embodiment to a plasma etching apparatus 200. The plasma etching apparatus 200 comprises a lower electrode 201, an upper electrode 202, and container 203 containing the lower electrode 201 and the upper electrode 202. When etching is performed, the lower electrode 201, the upper electrode 202 and the container 203 have high temperatures in this order. The temperature control apparatus 1 according to this embodiment is connected to the plasma etching apparatus 200 such that the first liquid flow apparatus 101 is connected to the lower electrode 201, that the second liquid flow apparatus 102 is connected to the upper electrode 202, and that the third liquid flow apparatus 103 is connected to the container 203. Thus, the plasma etching apparatus 200 can be efficiently cooled by the temperature control apparatus 1 according to this embodiment.

In this embodiment, although the temperature control apparatus 1 comprises the refrigeration apparatus 10 and the first to third liquid flow apparatuses 101 to 103, the refrigeration apparatus 10 may be used as an air conditioner without providing a liquid circulation apparatus.

1 Temperature control apparatus
10 Refrigeration apparatus
20 First refrigeration circuit
21 Compressor
22 Condenser
23 First expansion valve
24 First evaporator
30 Supercooling circuit
31 Supercooling bypass flow path
32 Supercooling control valve
33 Supercooling heat exchanger
40 Second refrigeration circuit
41 Branch flow path
42 Second expansion valve
43 Second evaporator
50 Heating-medium flow apparatus
51 First cooling flow path
52 Second cooling flow path
53 Cooling heat exchanger
60 Injection circuit
61 Injection flow path
62 Injection valve
70 Return circuit
71 Return flow path
72 Return adjustment valve
101 First liquid flow apparatus
101A First liquid flow path
112 First heater
102 Second liquid flow apparatus
102A Second liquid flow path
122 Second heater
X1, Y1, Z1 Pipe
X2, Y2, Z2 Temperature control object
200 Plasma etching apparatus
201 Lower electrode
202 Upper electrode
203 Container

What is claimed is:

1. A refrigeration apparatus comprising:

a first refrigeration circuit in which a compressor, a condenser, a first expansion valve and a first evaporator are connected such that a refrigerant is circulated in this order;

a supercooling circuit including: a supercooling bypass flow path which communicates a first part of the first refrigeration circuit, the first part being positioned on the downstream side of the condenser and on the upstream side of the first expansion valve, to a second part of the first refrigeration circuit, the second part being positioned on the compressor or on the upstream side of the compressor and on the downstream side of the first evaporator, such that the refrigerant can flow therethrough; a supercooling control valve which controls a flowrate of the refrigerant flowing through the supercooling bypass flow path; and a supercooling heat exchanger disposed on the downstream side of the supercooling control valve in the supercooling bypass flow path, the supercooling heat exchanger being configured to heat-exchange the refrigerant which has flown to the downstream side of the supercooling control valve, with the refrigerant which flows through a third part of the first refrigeration circuit, the third part being positioned on the downstream side of the condenser and on the upstream side of the first expansion valve, and the third part being on the downstream side of a connection position to the supercooling bypass flow path;

a second refrigeration circuit including: a branch flow path which communicates a fourth part of the first refrigeration circuit, the fourth part being on the downstream side of the condenser and on the upstream side of the first expansion valve, and the fourth part being on the upstream side of the connection position to the fifth supercooling bypass flow path, to a fifth part of the first refrigeration circuit, the fifth part being on the downstream side of the first evaporator and on the upstream side of the compressor, such that the refrigerant can flow therethrough; a second expansion valve disposed on the branch flow path, the second expansion valve being configured to expand the refrigerant received therein and to allow the refrigerant to flow out therefrom; and a second evaporator disposed on the downstream side of the second expansion valve in the branch flow path, the second evaporator being configured to evaporate the refrigerant having flown out from the second expansion valve; and an injection circuit including: an injection flow path which communicates a sixth part of the first refrigeration circuit, the sixth part being on the downstream side of the condenser and on the upstream side of the first expansion valve, and the sixth part being on the downstream side of a position at which the refrigerant is heat-exchanged by the supercooling heat exchanger, to a part of the branch flow path, the part of the branch flow path being on the downstream side of the second evaporator, such that the refrigerant can flow therethrough; and an injection valve which can adjust a flowrate of the refrigerant flowing through the injection flow path.

2. The refrigeration apparatus according to claim 1, further comprising a return circuit including: a return flow path which communicates a seventh part of the first refrigeration circuit, the seventh part being on the downstream side of the compressor and on the upstream side of the condenser, to an eighth part of the first refrigeration circuit, the eighth part being on the downstream side of the first evaporator and on the upstream side of the compressor, such that the refrigerant can flow therethrough; and a return adjustment valve which can adjust a flowrate of the refrigerant flowing through the return flow path.

3. The refrigeration apparatus according to claim 2, wherein the return adjustment valve is configured such that its opening degree is adjusted depending on a pressure difference between a pressure of the refrigerant which flows through a ninth part of the first refrigeration circuit, the ninth part being on the downstream side of the compressor and on the upstream side of the condenser, and a pressure of the refrigerant which flows through a tenth part of the first refrigeration circuit, the tenth part being on the downstream side of the first evaporator and on the upstream side of the compressor, and the tenth part being on the downstream side of a connection position to the branch flow path.

4. The refrigeration apparatus according to claim 1, further comprising a heating-medium flow apparatus including: a first cooling flow path connected to the condenser, the first cooling flow path being configured to supply the condenser with a heating medium for condensing the refrigerant flowing through the condenser and to allow the heating medium having flown out from the condenser to flow therethrough; a second cooling flow path which communicates a first part of the first cooling flow path, the first part of the first cooling flow path being positioned on the upstream side of the condenser, to a second part of the first cooling flow path, the second part of the first cooling flow path being positioned on the downstream side of the condenser, such that the heating medium can flow therethrough; and a cooling heat exchanger disposed on the second cooling flow path.

5. A temperature control apparatus comprising:

the refrigeration apparatus according to claim 1;

a first liquid flow apparatus including a first liquid flow path connected to the first evaporator in the first refrigeration circuit, the first liquid flow path being configured to supply the first evaporator with a first liquid to be cooled by the refrigerant flowing through the first evaporator and to allow the first liquid having flown out from the first evaporator to flow therethrough; and a second liquid flow apparatus including a second liquid flow path connected to the second evaporator in the second refrigeration circuit, the second liquid flow path being configured to supply the second evaporator with a second liquid to be cooled by the refrigerant flowing through the second evaporator and to allow the second liquid having flown out from the second evaporator to flow therethrough.

6. The temperature control apparatus according to claim 5, wherein the first liquid flow apparatus includes a first heater which heats the first liquid having been cooled by the refrigerant, and the second liquid flow apparatus includes a second heater which heats the second liquid having cooled by the refrigerant.

* * * * *